United States Patent [19]

Brudny-Chelyadinov et al.

[11] Patent Number: 4,606,700

[45] Date of Patent: Aug. 19, 1986

[54] TURBODRILL MULTISTAGE TURBINE

[75] Inventors: Sergei J. Brudny-Chelyadinov, Ljubertsy Moskovskoi; Vigdor S. Budyansky, Moscow; Viktor K. Sorokoumov, Moscow; Viktor A. Filimonov, Moscow, all of U.S.S.R.

[73] Assignee: Vsesojuzny Naucho-Issledovatelsky Institut Burovoi Tekhniki, Moscow, U.S.S.R.

[21] Appl. No.: 84,733

[22] Filed: Oct. 15, 1979

[51] Int. Cl.[4] ..... F01D 15/00

[52] U.S. Cl. ..... 415/199.5; 415/502

[58] Field of Search ..... 415/199.4, 199.5, 502, 415/503

[56] References Cited

U.S. PATENT DOCUMENTS 2,828,945 4/1958 New ..... 175/107

OTHER PUBLICATIONS

*The Oxford English Dictionary,* 1970 Edition, Oxford University Press, Ely House, London, p. 474.

*Primary Examiner*—Louis J. Casaregola

*Attorney, Agent, or Firm*—Lilling & Greenspan

[57] ABSTRACT

A turbodrill multistage turbine each stage of which comprises a stator and a coaxially disposed rotor. Each stator and rotor are provided with a respective spacing sleeve and a respective ring with respective flow channels and hubs. The hubs carry respective bladings disposed in the flow channels so that there are formed respective radial clearances between the ring of the stator and spacing sleeve of the rotor, and also between the ring of the rotor and spacing sleeve of the stator. At least in a number of rings the hubs are made such that there are pairs of adjacent rings in which at least a preceding (upstream) ring partially overlaps by its hub the flow channel of a subsequent (downstream) ring on the side of the radial clearance thereof.

7 Claims, 6 Drawing Figures

TURBODRILL MULTISTAGE TURBINE

The present invention relates to working members of turbodrills and more particularly to multistage turbines in which a drilling fluid is used as a flowing working medium.

The present invention can be most advantageously used in turbodrills intended for deep-hole drilling with diamond-set and roller-cone bits.

The present invention may also be conveniently used in hydraulic turbines intended for those applications which require a high torque without an increase of the turbine overall dimensions.

The multistage turbine of a turbodrill is a hydraulic turbine which can be actuated by water, mud, oil-base drilling fluids and aerated fluids. This turbine is essentially a row of alternate stators and rotors arranged so that within a pair the stator is always adjacent the rotor and vice versa. A single stator and rotor arranged one after the other make up a stage of the turbine.

In each turbine stage the stator and rotor are provided with rings and spacing sleeves.

Rotation of the rotor relative to the stator is ensured by the provision of axial and radial clearances.

The axial clearances are formed between the rings of the rotor and stator, whereas the radial clearances are formed between the stator ring and the rotor spacing sleeve, and also between the rotor ring and the stator spacing sleeve.

The rings of the stator and rotor are provided with flow channels and hubs carrying respective bladings which are essentially pluralities of blades equally spaced in the flow channel.

In a turbodrill multistage turbine two alternately spaced rings form a pair of rings. This pair may be composed of the stator and rotor rings or rotor and stator rings arranged one after the other.

Known in the art are turbodrill turbines having differently contrived stator and rotor flow channels (cf., "Turbodrilling of Oil Wells" by Shumilov P.P., Publishing House "Nedra", Moscow, 1968, p. 24, FIGS. 2 *a*, 2 *b*, in Russian). However, as in these and in the other known turbodrill turbines there is observed a principle of equal diametral dimensions of the flow channels at the exit from an upstream ring and at the entrance into a subsequent downstream ring.

A wide practical application has been found for the turbodrill turbines in which the flow channels of stator and rotors are made constant in diameter from the entrance to the exit, i.e. the stator and rotor bladings are confined by circular cylindrical surfaces. These turbodrill turbines designed to ensure a required rotation speed, flow rate and overall dimensions feature a comparatively low torgue of a single stage which, for the sake of obtaining the required torque on the shaft, necessitates the use of multisection turbodrills with a number of turbine stages over 400–500. In addition to the high cost the multisection turbodrills are not convenient in operation as they are substantially complicated in adjustment, assembly, transportation, etc. Besides, the known turbodrill turbines suffer from a considerable reduction of their energy parameters resulting from their wear. Due to this fact the turbodrill turbines operate with a reduced efficiency for an extended period of time.

It is an object of the present invention to increase the torque without changing the rotation frequency, flow rate and overall dimensions of the turbine.

It is another object of the invention to increase the period of the turbodrill turbine efficient operation.

The exact nature of the present invention resides in that in a turbodrill multistage turbine each stage of which comprises a stator and a coaxially disposed rotor each of which has a spacing sleeve and a ring with a flow channel for passing a flowing medium, and a hub carrying a blading disposed in the flow channel, with respective radial clearances being formed between the stator ring and the rotor spacing sleeve, and also between the rotor ring and the stator spacing sleeve, at least in a number of the rings the hubs are made so that there are pairs of adjacent rings in which at least a preceding (upstream) ring partially overlaps by its hub the flow channel of a subsequent (downstream) ring on the side of the radial clearance thereof.

Partial overlapping of the ring flow channel on the side of the ring radial clearance by the hub of a preceding ring allows the entire outgoing flow to be directed into the blading of a subsequent ring.

When the flow channel is partially overlapped the flow of working fluid passing thereinto is separated from the radial clearance by an annular zone the negotiation of which requires a considerable pressure head. The leakage of working fluid through the radial clearances is substantially reduced or completely eliminated depending on the hydraulic resistance of the blading. Reduction of the working fluid leakage is the main factor contributing to the stepping up of the torque and efficiency of the turbine.

It is preferable to make the rings of the stators and rotors throughout the entire length of the turbine such that the hubs of the preceding rings should partially overlap the flow channels of the subsequent rings on the side of the radial clearances thereof. In this case the maximum effect in increasing the torque will be attained.

A turbodrill multistage turbine may be suitably provided with bladings comprising the blades in which the camber line is curved through at least an acute angle formed by the tangent to this camber line at the blading exit and the centerline of a working medium flow. The blading provided with said blades features the minimum hydraulic resistance at operating duties close to the stagnation conditions, thus making it possible to decrease the leaks to the maximum extent at these operating duties at which the obtained torque determines the working torque with due account for a reserve of torque required for stable operation of the turbodrill.

It is desirable to make the flow channels of the turbodrill turbine such that the cross-sectional area at the exit of the flow channel of a preceding ring will be smaller than the cross-sectional area of the flow channel at the entrance of a subsequent ring and the relationship between these cross-sectional areas for each pair of the adjacent rings will be the same and substantially lies within the limits of 0.9 to 0.5. The results of performed experimental investigations have proved that in case the relationship between the cross-sectional areas of the flow channels at the exit from a preceding ring and at the entrance into a subsequent ring is maintained within the hereinabove mentioned limits, favorable conditions are created for an unobstructed entry of the working fluid into the blading, with the turbulence intensity therein substantially decreased. At the same time, it becomes possible to increase the mean radius at the exit of the rotor flow channel which presents one more factor contributing to the stepping up of the torque.

Besides, it is also preferable that the generatrices of hub surfaces defining a respective flow channel of at least a preceding ring from a pair of the adjacent rings, are made in the form of two conjugating arcs of the opposite concavity such that the first downstream arc faces the flow centerline by its concavity and the other arc faces this centerline by its convexity, and their common chord from the entrance to the exit of the flow channel is inclined relative to the flow centerline.

An embodiment of the flow channels having hub surfaces with such configuration of generatrices ensures the reduction of churning losses in the turbine.

The invention will be further described with reference to specific embodiments thereof, taken in conjunction with the accompanying drawings, wherein.

A turbodrill multistage turbine is a driving working member of a turbodrill (FIG. 1) with a rock-breaking tool (not shown in Fig.) connected to a shaft 1 thereof and a drill pipe (not shown in Fig.) connected to a casing 2. The shaft 1 is held centrally in the casing 2 by means of radial bearings 3 which ensures coaxial rotation of the shaft 1 relative to a centerline O thereof.

Figure 1:
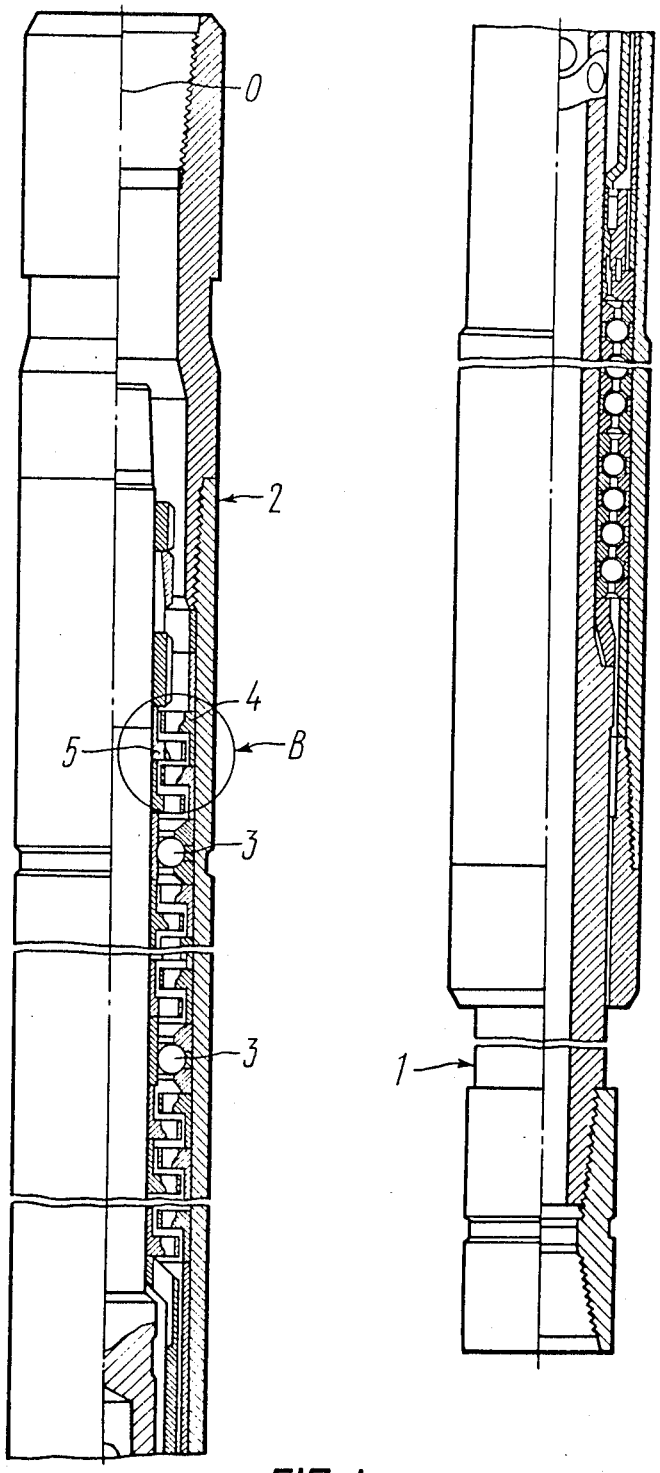
FIG. 1 is a general view of a turbodrill comprising a multistage turbine according to the invention.
Figure 2:
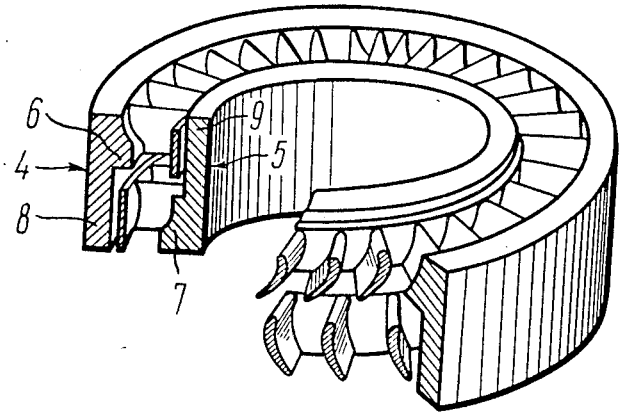
FIG. 2 is a three-dimensional view of a turbine stage according to the invention.

Each stage of the turbodrill turbine comprises a stator 4 and a rotor 5 (FIGS. 1,2).

In the turbodrill a system of the stator 4 (FIG. 1) is rigidly secured in the casing 2 and a system of the rotors 5, on the shaft 1.

In each stage the stator 4 (FIG. 3) and the rotor 5 are provided with respective rings 6 and 7, and also with respective spacing sleeves 8 and 9 which define between the like rings a space wherein an adjacent ring is disposed with respective axial clearances 10, 11.

The rings 6 and 7 of the stator 4 and the rotor 5 respectively are provided with respective flow channels 12, 13, and also with hubs 14, 15 carrying bladings 16, 17 (FIGS. 3,4) disposed in the flow channels 12, 13 thereof.

A straight line S parallel to the axis 0 of rotation and passing inside the channels 12, 13 is a flow centerline indicating the direction of the working medium flow.

Two adjacent rings disposed along the centerline S (FIG. 3) form a pair of rings one of which is the ring 6 of the stator 4 and the other one is the ring 7 of the rotor 5.

In a pair of associated rings the rings may be arranged streamwise in two ways, viz., the ring 6 of the stator and the ring 7 of the rotor, or the ring 7 of the rotor and the ring 6 of the stator.

Formed between the ring 6 of the stator 4 and the spacing sleeve 9 of the rotor 5, as well as between the ring 7 of the rotor 5 and the spacing sleeve 8 of the stator 4 are respective radial clearances 18 and 19.

The value of the radial clearances 18 and 19 is established at a minimum proceeding from the possibility of assembling a multistage turbine in the turbodrill and with a due account of the radial wear in the bearings 3 (FIG. 1).

Figure 3:
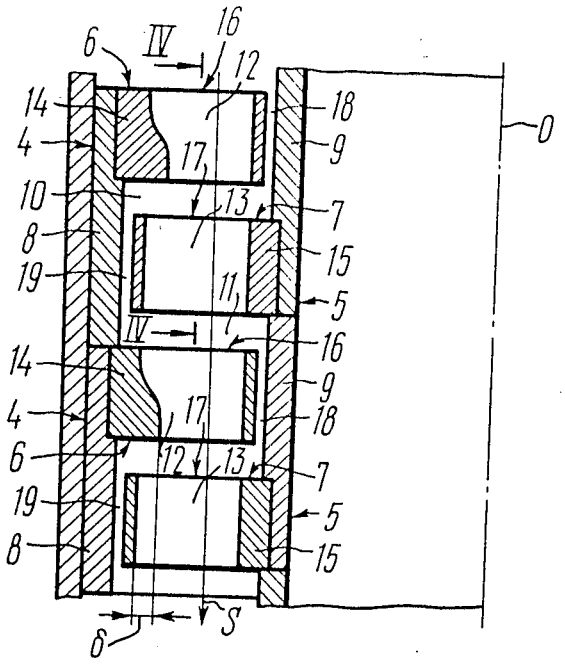
FIG. 3 is a view taken along the arrow B of FIG. 1, including two turbine stages.
Figure 4:
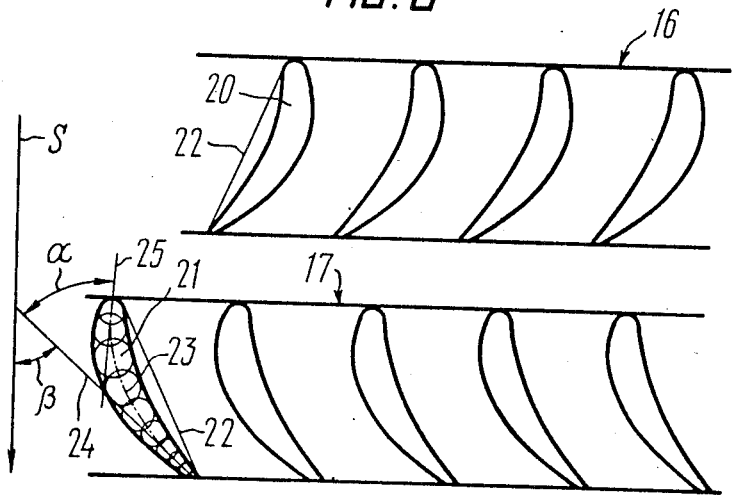
FIG. 4 is a section of a turbine blading taken on the line IV—IV of FIG. 3 (developed on a plane for clarity)

The bladings 16, 17 of the stator 4 and the rotor 5 (FIG. 4) are essentially pluralities of blades 20, 21 equally spaced in the flow channels 12, 13 (FIG. 3). The blades 20 (FIG. 4) of the stator and the blades 21 of the rotor are inclined by their chords 22 downstream in the opposite directions relative to the flow centerline S.

The profile of any blade is usually characterized in the art by a camber line 23, tangents 24 and 25 to the camber line 23 at the exit and entrance of the blading, a camber angle $\alpha$ of the camber line 23 and by an angle $\beta$ between the tangent 24 and the flow centerline S.

Embodiment of the flow channels 12, 13 (FIG. 5) is governed by the configuration of generatrices 26, 27 of the surfaces of the hubs 14, 15 defining the flow channels 12, 13, and by the inclination of their chords 28, 29 relative to the flow centerline S.

Figure 5:
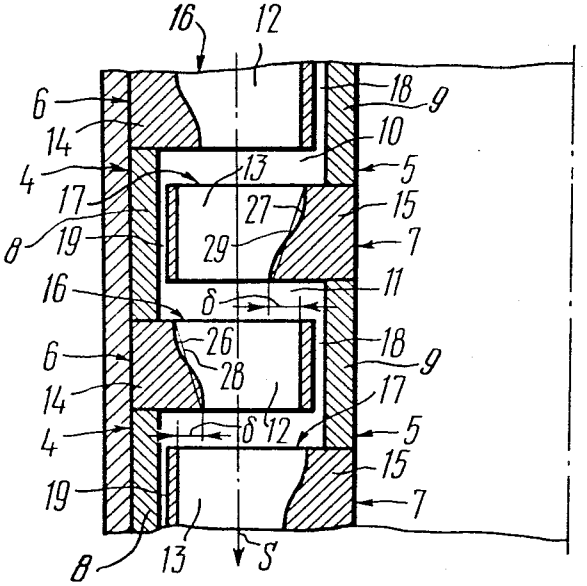
FIG. 5 is an alternative embodiment of a turbine according to the invention with shrouds encompassing bladings of a stator and rotor, and with rings and spacing sleeves of a stator and rotor made as separate parts.

It will be appreciated that the generatrices 26, 27 may be made, for example, in the form of two conjugating arcs of the opposite concavity (FIG. 5).

Figure 6:
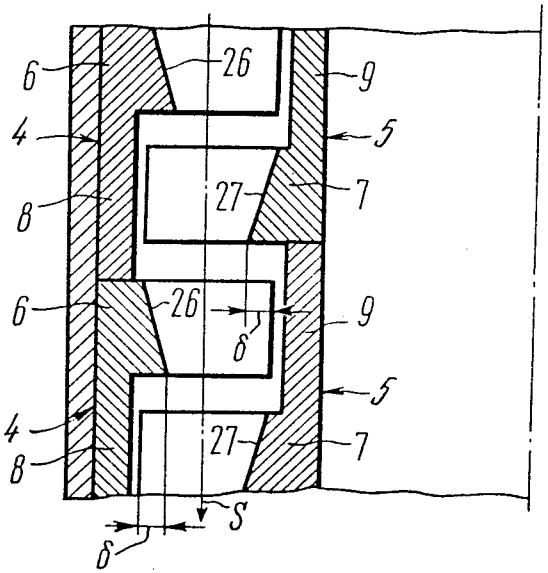
FIG. 6 is an alternative embodiment of a turbine according to the invention with rings having no shrouds and made integral with spacing sleeves of a stator and rotor.

The stators 4 and the rotors 5 may be made monolithic (FIGS. 2, 6). Then, their rings 6, 7 are made integral with the spacing sleeves 8, 9. The rings 6, 7 and the spacing sleeves 8, 9 of the stators 4 and rotors 5 may be made in the form of separate parts (FIGS. 3, 5).

Irrespective of a structural embodiment of the stators 4 and rotors 5, according to the invention at least in a number of the rings 6 and/or 7 the hubs 14 and/or 15 are made such that there are pairs of the adjacent rings 6 and 7 in which at least the preceding (upstream) ring 6 or 7 partially overlaps by its hub 14 or 15 the flow channel 12 or 13 of the subsequent ring 7 or 6 on the side of the radial clearance 19 or 18 thereof.

In FIGS. 3, 5, 6 partial overlapping of the flow channels is designated by a dimension "$\delta$". The partial overlapping $\delta$ makes it possible to direct the flow of the working fluid without a loss (leakage) of some fluid through the radial clearances 18 and 19 directly into the downstream flow channels 12 and 13 wherein the bladings 16 and 17 convert the hydraulic energy of fluid to the mechanical energy of rotation. Elimination of the working fluid leakage is the main factor contributing to the stepping up of the torgue and efficiency of the turbine.

With the partial overlapping $\delta$ of the flow channels 12 and/or 13 the flow of working fluid passing thereinto is separated from the respective radial clearances 18 and/or 19 by an annular zone approximately equal in width to $\delta$. Negotiation of this zone requires a great pressure head. The maximum increase of torque is obtained when the partial overlapping $\delta$ is accomplished by the hubs 14 and 15 in respect to the flow channels 12 and 13 throughout the entire length of the turbine.

The blading 17 or 16 (FIGS. 3, 4, 5) of at least the downstream ring 7 or 6 from a pair of the adjacent rings 6 and 7 or 7 and 6 may be preferably made such that the blades 21 or 20 of these bladings have the camber line 23 curved through a camber angle $\beta$ which is not less than the acute angle $\beta$ defined by the tangent 24 to the camber line 23 at the exit of the blading 17 or 16 and the flow centerline S.

The bladings 16 and/or 17 provided with said blades 21 and/or 20 feature the minimum hydraulic resistance at operating duties close to the stagnation conditions, thus making it possible to decrease to the maximum extent the leaks through the radial clearances 19 and/or 18 at these operating duties at which the obtained torque determines the working torque with due account for a reserve of torque required for stable operation of the turbodrill.

It is desired to make the flow channels 12 and 13 (FIGS. 5, 6) such that the relationship between the cross-sectional areas thereof at the exit of the preceding ring 6 or 7 and at the entrance of the subsequent ring 7 or 6 for each pair of the ajacent rings 6 and 7 or 7 and 6 will be the same and substantially lies within the limits of 0.9 to 0.5.

The results of performed experimental investigations have proved that in case the relationship between the cross-sectional areas of the flow channels 12 and 13 at the exit from the preceding ring 6 or 7 and at the entrance into the subsequent ring 7 or 6 is maintained within the heretofore mentioned limits, favorable conditions are created for an unobstructed entry of the working fluid into the bladings 17 and 16 and for a stall-free flow of the fluid therethrough.

At the same time it becomes possible to increase the mean radius at the exit of the flow channel 13 of the rotors 5 which presents one more fact contributing to the stepping up of the torque.

Besides, it is also preferable that the generatrices 26, 27 of the surfaces of the hubs 14, 15 defining the respective flow channels 12, 13 are made in the form of two conjugating arcs of opposite concavity such that the first (upstream) arc faces the flow centerline S by its concavity and the other arc faces this centerline by its convexity, and their common chords 28, 29 from the entrance to the exit of the flow channel are inclined relative to the flow centerline.

An embodiment of the flow channels 12, 13 having such configuration of the generatrices 26, 27 ensures the reduction of churning losses in the turbine.

The turbodrill multistage turbine according to the invention operates in the following way.

From the surface the mud pumps deliver the drilling fluid to the turbodrill (FIG. 1) through the drill pipes (not shown in Fig.). Upon entering the first stator 4 this fluid acquires a tangential deflection in the blading 16 thereof. At the same time the drilling fluid interacts with the surface of the hub 14 (FIG. 5) with the result that the flow of fluid passing out of the flow channel 12 acquires a designed deflection away from the radial clearance 19 due to a partial overlapping $\delta$ of the flow channel 13 by the hub 14.

Upon leaving the flow channel 12 of the stator 4, the flow of drilling fluid somewhat expands in the axial clearance 10 due to the increase of the flow area. However, the value of the overlapping $\delta$ is selected so that at given operating duties of the turbine the flow of drilling fluid readily enters the entrance of the flow channel 13 of the ring 7 of the rotor 5 and does work while passing through the blading 17. Here, due to the interaction with the hub 15 the drilling fluid is transferred radially away from the radial clearance 18 for a greater radius which adds to the stepping up of the torque.

Despite a certain expansion of the drilling fluid flow in the axial clearance 11, it practically completely enters the flow channel 12 of the subsequent ring 6 of the stator 4.

The heretofore described process is repeated in this stator 4, in the following rotor 5 and further in the downstream stages of the turbine.

As follows from the disclosed operation of a turbodrill multistage turbine embodied according to the invention, leaks of the drilling fluid through the radial clearances at given operating duties of the turbine are eliminated due to the fact that the hub of a preceding ring partially overlaps the flow channel of a subsequent ring on the side of the radial clearance thereof.

What is claimed is:

1. A turbodrill multistage turbine each stage of which comprises: a stator having a spacing sleeve separating adjacent stators of stages from one another, and a ring provided with a hub carrying a blading which defines a flow channel for passing a flowing medium; a rotor also having a spacing sleeve separating adjacent rotors of stages from one another, and a ring including a hub carrying a blading which defines a flow channel for passing a flowing medium, said rotor being disposed coaxially with said stator so that there are formed respective radial clearances between said ring of said stator and said spacing sleeve of said rotor, and also between said ring of the rotor and said spacing sleeve of the stator, and at least in a number of said rings the hubs are made such that there are pairs of adjacent rings in which at least a preceding (upstream) ring partially overlaps by its hub the flow channel of a subsequent (downstream) ring on the side of the radial clearance thereof, wherein the relationship between the cross-sectional area of a flow channel at the exit of a preceding ring and the cross-sectional area of a flow channel at the entrance of a subsequent ring for each said pair of adjacent rings is the same and lies substantially within the limits of 0.9 to 0.5.

2. A turbodrill multistage turbine each stage of which comprises: a stator having a spacing sleeve separating adjacent stators of stages from one another, and a ring provided with a hub carrying a blading which defines a flow channel for passing a flowing medium; a rotor also having a spacing sleeve separating adjacent rotors of stages from one another, and a ring including a hub carrying a blading which defines a flow channel for passing a flowing medium, said rotor being disposed coaxially with said stator so that there are formed respective radial clearances between said ring of said stator and said spacing sleeve of said rotor, and also between said ring of the rotor and said spacing sleeve of the stator, and at least in a number of said rings the hubs are made such that there are pairs of adjacent rings in which at least a preceding (upstream) ring partially overlaps by its hub the flow channel of a subsequent (downstream) ring on the side of the radial clearance thereof, wherein said rings of said stator and rotor are made throughout the entire length of the turbine such that said hubs of preceding rings partially overlap the flow channels of subsequent rings on the side of the radial clearances thereof, and wherein the relationship of the cross-sectional area of a flow channel at the exit of a preceding ring and the cross-sectional area of a flow channel at the entrance of a subsequent ring for each said pair of adjacent rings is the same and lies substantially within the limits of 0.9 to 0.5.

3. A turbodrill multistage turbine each stage of which comprises: a stator having a spacing sleeve separating adjacent stators of stages from one another, and a ring provided with a hub carrying a blading which defines a flow channel for passing a flowing medium; a rotor also having a spacing sleeve separating adjacent rotors of stages from one another, and a ring including a hub carrying a blading which defines a flow channel for passing a flowing medium, said rotor being disposed coaxially with said stator so that there are formed respective radial clearances between said ring of said stator and said spacing sleeve of said rotor, and also between said ring of the rotor and said spacing sleeve of the stator, and at least in a number of said rings the hubs are made such that there are pairs of adjacent rings in which at least a preceding (upstream) ring partially overlaps by its hub the flow channel of a subsequent (downstream) ring on the side of the radial clearance thereof, wherein said blading of at least a subsequent ring from a pair of adjacent rings comprises blades in which the camber line is curved through not less than an acute angle defined by the tangent to this camber line at the exit of the blading and the centerline of a flowing medium, and wherein the relationship between the cross-sectional area of a flow channel at the exit of a preceding ring and the cross-sectional area of a flow channel at the entrance of a subsequent ring for each said pair of adjacent rings is the same and lies substantially within the limits of 0.9 to 0.5.

4. A turbodrill multistage turbine each stage of which comprises: a stator having a spacing sleeve separating adjacent stators of stages from one another, and a ring provided with a hub carrying a blading which defines a flow channel for passing a flowing medium; a rotor also having a spacing sleeve separating adjacent rotors of stages from one another, and a ring including a hub carrying a blading which defines a flow channel for passing a flowing medium, said rotor being disposed coaxially with said stator so that there are formed respective radial clearances between said ring of said stator and said spacing sleeve of said rotor, and also between said ring of said rotor and said spacing sleeve of said stator, and at least in a number of said rings the hubs are made such that there are pairs of adjacent rings in which at least a preceding (upstream) ring partially overlaps by its hub the flow channel of a subsequent (downstream) ring on the side of the radial clearance thereof, the generatrix of the hub surface defining a respective flow channel of at least a preceding ring from a pair of adjacent rings is made in the form of two conjugating arcs of the opposite concavity so that the first (upstream) arc faces the flow centerline by its concavity and the other arc faces this centerline by its convexity, and their common chord from the entrance to the exit of a flow channel is inclined relative to the flow centerline.

5. A turbodrill multistage turbine each stage of which comprises: a stator having a spacing sleeve separating adjacent stators of stages from one another, and a ring provided with a hub carrying a blading which defines a flow channel for passing a flowing medium; a rotor also having a spacing sleeve separating adjacent rotors of stages from one another, and a ring including a hub carrying a blading which defines a flow channel for passing a flowing medium, said rotor being disposed coaxially with said stator so that there are formed respective radial clearances between said ring of said stator and said spacing sleeve of said rotor, and also between said ring of said rotor and said spacing sleeve of said stator, and at least in a number of said rings the hubs are made such that there are pairs of adjacent rings in which at least a preceding (upstream) ring partially overlaps by its hub the flow channel of a subsequent (downstream) ring on the side of the radial clearance thereof, said rings of said stator and rotor being made throughout the entire length of the turbine such that said hubs of preceding rings partially overlap the flow channels of subsequent rings on the side of the radial clearances thereof, and the generatrix of the hub surface defining a respective flow channel of at least a preceding ring from a pair of adjacent rings is made in the form of two conjugating arcs of the opposite concavity such that the first (upstream) arc faces the flow centerline by its concavity and the other arc faces this centerline by its convexity, and their common chord from the entrance to the exit of a flow channel is inclined relative to the flow centerline.

6. A turbodrill multistage turbine each stage of which comprises: a stator having a spacing sleeve separating adjacent stators of stages from one another, and a ring provided with a hub carrying a blading which defines a flow channel for passing a flowing medium; a rotor also having a spacing sleeve separating adjacent rotors of stages from one another, and a ring including a hub carrying a blading which defines a flow channel for passing a flowing medium, said rotor being disposed coaxially with said stator so that there are formed respective radial clearances between said ring of said stator and said spacing sleeve of said rotor, and also between said ring of said rotor and said spacing sleeve of said stator, and at least in a number of said rings the hubs are made such that there are pairs of adjacent rings in which at least a preceding (upstream) ring partially overlaps by its hub the flow channel of a subsequent (downstream) ring on the side of the radial clearance thereof, said blading of at least a subsequent ring from a pair of adjacent rings comprising blades in which the camber line is curved through not less than an acute angle defined by the tangent to this camber line at the exit of the blading and the centerline of a flowing medium, and the generatrix of the hub surface defining a respective flow channel of at least a preceding ring from a pair of adjacent rings is made in the form of two conjugating arcs of the opposite concavity such that the first (upstream) arc faces the flow centerline by its concavity and the other arc faces this centerline by its convexity, and their common chord from the entrance to the exit of a flow channel is inclined relative to the flow centerline.

7. A turbodrill multistage turbine each stage of which comprises: a stator having a spacing sleeve separating adjacent stators of stages from one another, and a ring provided with a hub carrying a blading which defines a flow channel for passing a flowing medium; a rotor also having a spacing sleeve separating adjacent rotors of stages from one another, and a ring including a hub carrying a blading which defines a flow channel for passing a flowing medium, said rotor being disposed coaxially with said stator so that there are formed respective radial clearances between said ring of said stator and said spacing sleeve of said rotor, and also between said ring of said rotor and said spacing sleeve of said stator, and at least in a number of said rings the hubs are made such that there are pairs of adjacent rings in which at least a preceding (upstream) ring partially overlaps by its hub the flow channel of a subsequent (downstream) ring on the side of the radial clearance thereof, the relationship between the cross-sectional area of a flow channel at the exit of a preceding ring and the cross-sectional area of a flow channel at the entrance of a subsequent ring for each said pair of adjacent rings being the same and lying substantially within the limits of 0.9 to 0.5, and the generatrix of the hub surface defining a respective flow channel of at least a preceding ring from a pair of adjacent rings is made in the form of two conjugating arcs of the opposite concavity such that the first (upstream) arc faces the flow centerline by its concavity and the other arc faces this centerline by its convexity, and their common chord from the entrance to the exit of a flow channel is inclined relative to the flow centerline.

* * * * *